US007587861B2

(12) United States Patent
Bongard

(10) Patent No.: US 7,587,861 B2
(45) Date of Patent: Sep. 15, 2009

(54) SECURITY COVER FOR RECIPROCATING GATE ARM

(76) Inventor: Peter Bongard, 49371 Gila River St., Indio, CA (US) 92201

( * ) Notice: Subject to any disclaimer, the term of this patent is extended or adjusted under 35 U.S.C. 154(b) by 302 days.

(21) Appl. No.: 11/512,594

(22) Filed: Aug. 30, 2006

(65) Prior Publication Data

US 2008/0127557 A1 Jun. 5, 2008

(51) Int. Cl.
*E05B 65/06* (2006.01)

(52) U.S. Cl. ..... 49/394; 49/35; 49/363; 49/340; 49/339; 49/344; 49/345; 70/163; 70/164; 70/165; 70/166; 70/167; 70/168; 70/169; 70/170; 70/171; 70/172; 70/173; 292/137; 292/252; 292/1

(58) Field of Classification Search ..... 49/35, 49/363, 360; 292/1, 137, 252, 104, 150, 292/147; 70/158, 163–173, 232, DIG. 57
See application file for complete search history.

(56) References Cited

U.S. PATENT DOCUMENTS 1,176,828 A * 3/1916 Haddow ..... 292/174
4,003,161 A * 1/1977 Collins ..... 49/35
4,029,370 A * 6/1977 Ziegel et al. ..... 312/284
4,300,373 A * 11/1981 Camos et al. ..... 70/232
4,422,314 A * 12/1983 Cooper ..... 70/242
4,553,415 A * 11/1985 Maffey ..... 70/232
4,557,458 A * 12/1985 Vahlberg et al. ..... 248/553
4,592,218 A * 6/1986 Chechovsky et al. ..... 70/164
4,601,502 A * 7/1986 Van Dyke ..... 292/252
4,697,443 A * 10/1987 Hillin ..... 70/121
5,024,474 A * 6/1991 Selby, III ..... 292/252
5,092,637 A * 3/1992 Miller ..... 292/173
5,797,285 A * 8/1998 Sackowitz ..... 70/177
5,895,169 A * 4/1999 Holm et al. ..... 404/9
5,904,057 A * 5/1999 Abney et al. ..... 70/167
6,070,441 A * 6/2000 Bernstrom ..... 70/58
6,082,601 A * 7/2000 Standish ..... 224/569
6,336,294 B1 * 1/2002 Kowalczyk et al. ..... 49/339
6,354,116 B1 * 3/2002 Drake ..... 70/178
6,676,465 B2 * 1/2004 Karvinen ..... 440/55
6,793,081 B1 * 9/2004 Derman ..... 215/201
7,487,652 B2 * 2/2009 Marszalek et al. ..... 70/58
2006/0130544 A1 * 6/2006 Nickeas et al. ..... 70/163

* cited by examiner

*Primary Examiner*—Jerry Redman
*Assistant Examiner*—Jeff Tang
(74) *Attorney, Agent, or Firm*—Fulwider Patton LLP

(57) ABSTRACT

A security cover for an automatic gate arm protects against disengagement and removal of the gate arm for the purpose of unauthorized entry through the gate. The security cover comprises four walls and a top plate joined to form a housing that encloses a rotating turret and a portion of a drive arm used to actuate the gate. The security cover mounts over the turret using a vertical rod that extends from above the housing to a location within the drive mechanism of the gate arm motor, and a lock that secures the housing and prevents unauthorized tampering with the drive arm.

5 Claims, 3 Drawing Sheets

SECURITY COVER FOR RECIPROCATING GATE ARM

BACKGROUND OF THE INVENTION

The present invention relates generally to entrance security devices, and more particularly to a protective cover for a gate arm used to open and close gates such as those used in gated communities, to prevent removal of the gate arm for the purposes of unauthorized entry.

Gated communities have gained increased popularity in the last ten to twenty years as a form of home protection from a criminal element. These homes are designed with limited ingress and egress, coupled with a gate that is actuated by an RF remote, magnetic key card, or other form of recognition that permits authorized entrants of the community access but restricts unauthorized persons from gaining entry. In this manner, the occupants of the community are assured some level of protection against thieves, vagrants, vandals, and other undesirables. Typically, the main entry gates are monitored by watchmen, cameras, or two-way communication devices that allows visitors, deliveries, emergency personnel, and other non-residents to enter the premises. However, other gated exits may be unguarded since they are used exclusively to allow the residents to exit the premises.

The gates used to police these communities are typically driven by a drive system using hydraulic power or an electric motor coupled to a gear system that drives a gate arm. The gate arm is rigidly mounted to a gate that either slides linearly along a track from an open position to a close position, or the gate may be hinged on one side such that the movement of the gate arm rotates the hinged gate open and closed. An example of the latter system is disclosed in U.S. Pat. No. 4,403,449 to Richmond, the contents of which are fully incorporated herein by reference. In Richmond, the lever arm 40 is connected to a drive mechanism 38 and transmits the force from the drive mechanism to open the gate. The lever arm 40 also prevents the gate from opening, for example, by force if an intruder sought to move the gate and gain unauthorized entry.

The problem with present systems such as that disclosed in Richmond is that an intruder can, for example, gain access to the gate opening and closing apparatus and disengage the lever arm 40, by tool or by pulling the arm out of its socket. With the lever arm removed from the gate opening and closing apparatus, the gate can be freely opened and closed and thus an intruder can enter with a vehicle and defeat the purpose of the gated community. This problem is rampant among such gated communities and yet no effective, reliable solution exists for this problem this is economical, can be retrofitted for most existing applications, and completely solves the problem. The present invention is a solution to the problem achieving all of the aforementioned objects.

SUMMARY OF THE INVENTION

The present invention is a security cover for a security gate arm to protect the arm from being disconnected, thereby allowing the security gate to be opened by unauthorized personnel. The cover is constructed with a rectangular housing that mounts over the upper turret of the arm drive and encloses the turret that houses the drive arm for the gate, as well as the rectangular awning structure that extends radially from the turret to shelter the drive arm. The cover further comprises a vertically disposed rod extending downward through the rectangular housing and through the turret to the gear box of the drive system where the rod is rigidly fixed, the rod extending one to two inches above the housing when the housing in mounted over the turret. The cover further comprises a locking mechanism that couples to the vertical rod to fix the cover over the turret and prevent unauthorized access to the connection of the security gate's drive arm.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
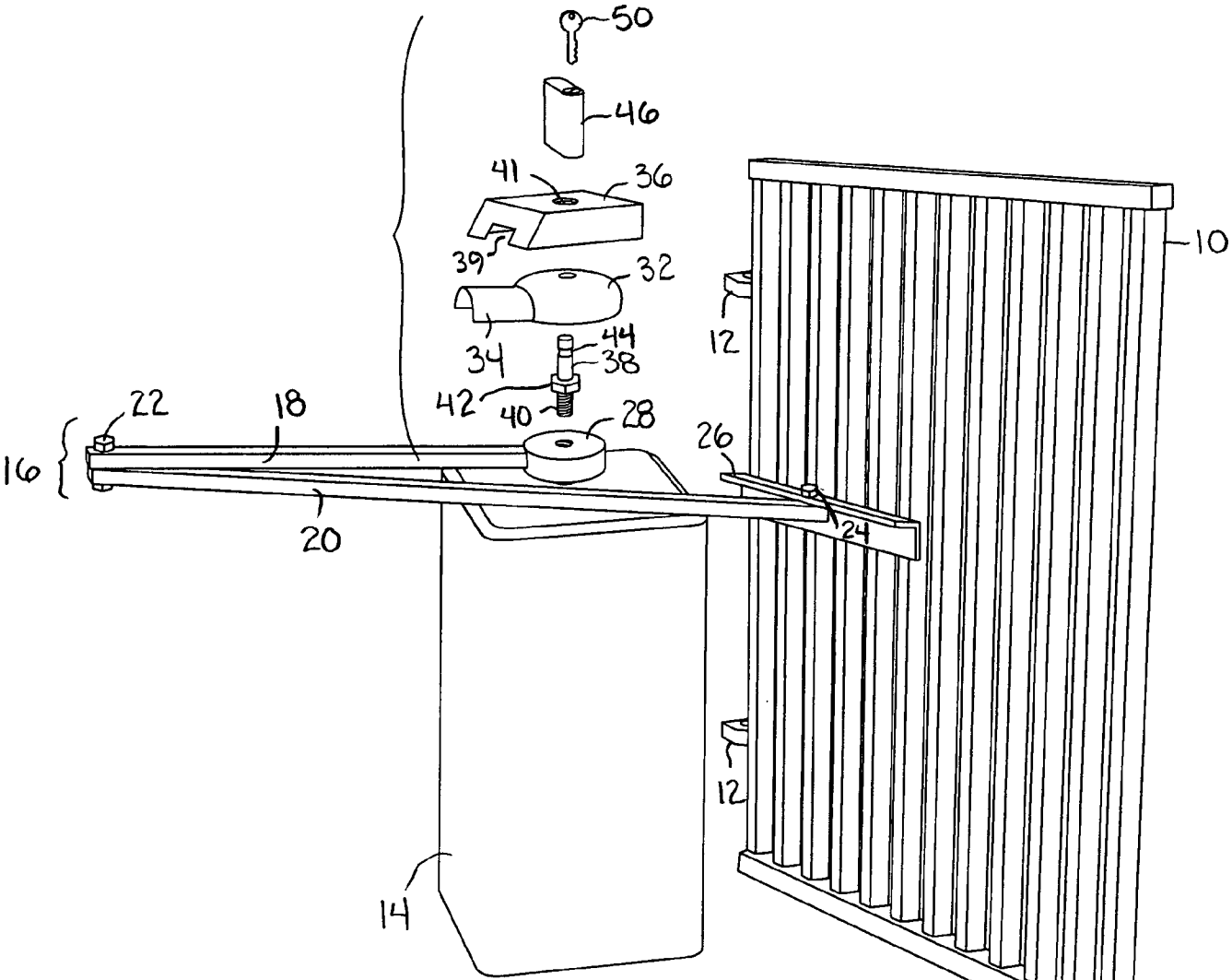
FIG. 1 is a perspective exploded view of a first preferred embodiment of the present invention.
Figure 2:
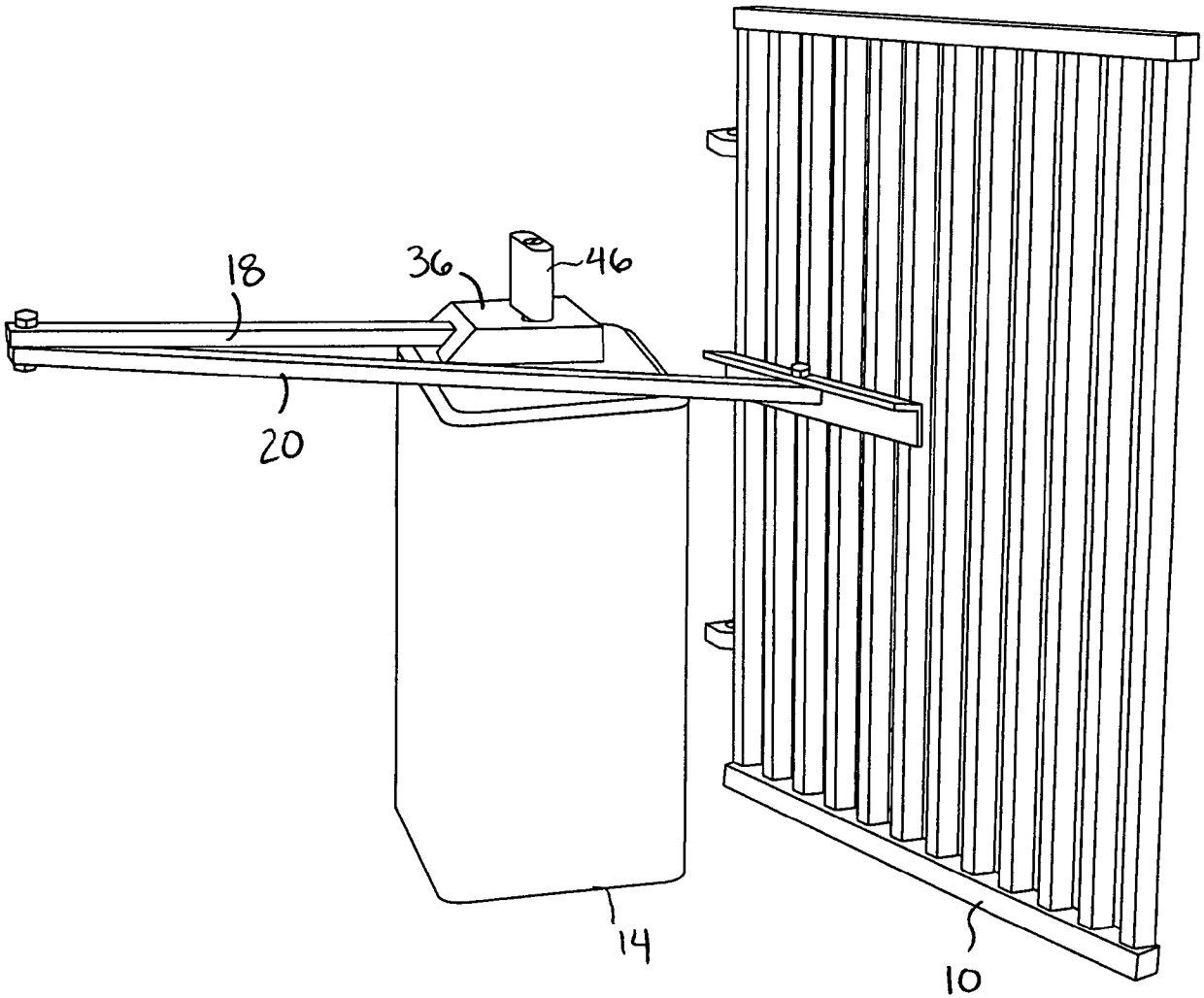
FIG. 2 is a perspective view of the embodiment of FIG. 1.

FIGS. 1 and 2 illustrate a first preferred embodiment of the present invention, wherein a pivotally gate 10 secured at lugs 12 to a fixed post (not shown) so as to rotate about the post and, in that manner, open and close the gate 10. Other kinds of gates, such as sliding gates that reciprocate along a horizontal track, will also work equally well with the present invention. The gate 10 is driven by a motor driven actuator 14 having a linkage 16 in a reciprocating motion that opens and closes the gate 10. The linkage 16 is formed by a driver arm 18 and an attachment arm 20 linked together by a fastener 22 that permits the linkage to expand and contract about the fastener 22. The attachment arm 20 is mounted to the gate at bracket 26 in any reliable fashion, such as for example fastener 24, although welding or other methods of affixing the bar to the gate would be within the scope of the present invention.

The drive arm 18 of the drive actuator 14 is inserted in to a slot in a cylindrical support 28 that is connected to a vertical rod 30. The rod 30 is connected to an electric motor (not shown) that is actuated by either a remote control, key card, push button, or other means to drive the gate open and closed via actuator 14. The cylindrical support 28 is housed in a turret-shaped dome structure 32 having semi-cylindrical sleeve 34 that shields the connection of the drive arm 18 to the support 28 and helps to protect the motor and the drive mechanisms from rain, dirt, and contamination. The description of the forgoing in well known in the art.

Figure 3:
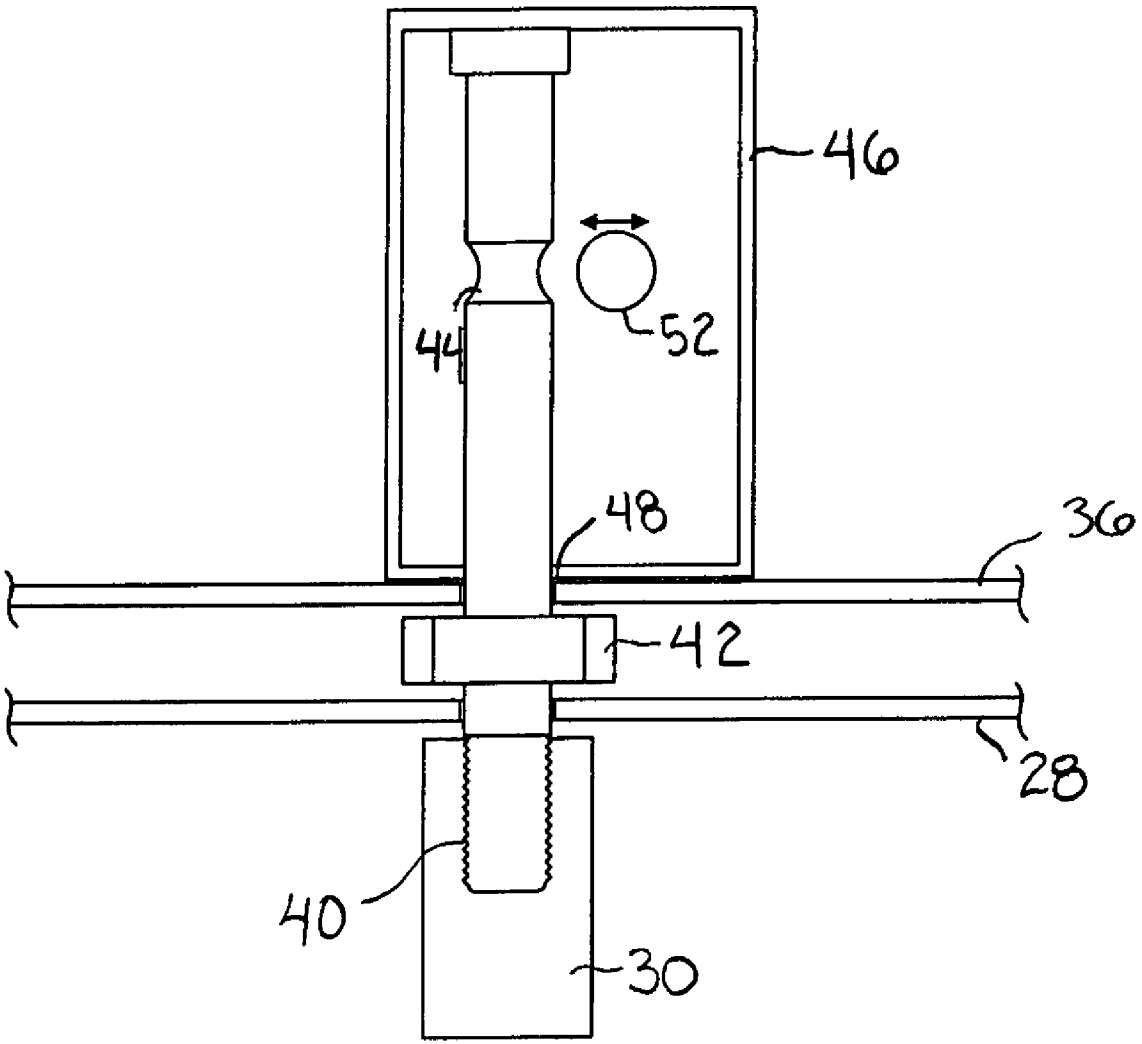
FIG. 3 is an enlarged, cross-sectional view of a locking mechanism for the first embodiment.

As discussed in the background section of the specification, removal of the dome structure 32 or other housing exposes the connection of the drive arm 18 to the cylindrical support, permitting removal of the drive arm 18 or otherwise disabling the mechanism. With the drive arm removed, the gate 10 can be easily opened and closed, thereby permitting unauthorized access through the gate. To prevent the removal of the drive arm 18, the present invention comprises a security cover 36 that fits over the housing 32, having a length that extends beyond the semi-cylindrical sleeve 34 and a width that is slightly larger than the diameter of the dome structure such that the security cover 36 fits completely over the dome structure without impeding the operation of the drive actuator 14. The security cover 36 can be rectangular, with an upper wall, front and rear ends, and left and right sides cooperating forming a rigid protective configuration. The securing cover includes an opening 39 at a front end that permits the drive arm 18 to extend therefrom, and further includes an aperture 41 on its top surface for receiving a lock rod 38. The security cover overlays the housing 32, such that the housing is free to rotate as necessary to control the movement of the gate 10. The lock rod preferably has a threaded end 40 that secures to the gear box of the motor in the drive actuator, or some other rigid structure the precludes removal of the lock rod 38. The threaded end 40 terminates at a hexagonal nut 42 that fixes the length of the lock rod 38 that is inserted into the gear box (not shown). Above the nut 42, the lock rod includes an elongate extension that includes a neck portion 44 as shown in FIG. 3. The neck portion 44 is spaced from the upper end of the lock rod and provides a docking point for a locking device 46 placed over the lock rod 38. The locking device 46 has a hole 48 that is sized to receive the lock rod therein, and is actuated by a key 50 or other lock actuating means. When the key 50 is rotated, a cylindrical bar 52 is rotated into contact with the neck portion 44 of the lock rod, fixing the locking device 46 on the lock rod 38. With the locking device 46 fixed on the lock rod 38, the security cover 36 cannot be removed from its position over the housing 32, and thus the drive arm 18 cannot be tampered with by unauthorized personnel. When the key 50 is rotated to the unlock position, the cylindrical bar 52 is translated out of contact with the neck portion 44 of the lock rod by a worm gear or other mode of translation, thereby permitting removal of the locking device 46 and the security cover 36. Thus, the present invention provides a simple, cost effective means of preventing unauthorized access to an automatic gate arm and thus improve security to gated communities.

I claim:

1. A security cover for an automatic gate drive including a horizontally extending drive arm and a dome to house the connection of the drive arm to a drive mechanism, the security cover comprising:

a rigid, metal housing having first and second substantially parallel side walls, a rear wall, a front wall, and a top plate cooperating to form and enclosure sized to receive said dome thereunder, said top plate including an aperture extending through;

a metal rod extending vertically from a first end above the top plate, through the aperture in the top plate and through a top of the dome to a position within the drive mechanism; and a releasable locking means on said first end of said metal rod to lock said housing over said dome;

wherein the metal housing is sized to receive thereunder a sleeve radially protruding from the dome about at least part of said drive arm.

2. The security cover of claim 1 wherein the security cover is free to rotate with the dome as the drive mechanism moves the drive arm.

3. The security cover of claim 1 wherein the front wall of the metal housing has a rectangular aperture sized to pass receive the drive arm such that the drive arm projects through said aperture when said security cover is installed.

4. The security cover of claim 1 wherein said metal rod includes a neck portion disposed above said housing at said first end, said locking means cooperating with said neck portion to fix said housing over said dome.

5. The security cover of claim 4 wherein the locking means includes a roller that abuts against said neck portion on said rod in a first position corresponding to a locked position, and shifts away from said neck portion in a second position corresponding to an unlocked position.

* * * * *